US007971314B2

(12) United States Patent
Hollis

(10) Patent No.: US 7,971,314 B2
(45) Date of Patent: Jul. 5, 2011

(54) OVAL FILTER CAGE AND VACUUM CLEANER

(75) Inventor: Robert Hollis, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 1080 days.

(21) Appl. No.: 11/627,467

(22) Filed: Jan. 26, 2007

(65) Prior Publication Data

US 2008/0127449 A1 Jun. 5, 2008

Related U.S. Application Data

(60) Provisional application No. 60/867,953, filed on Nov. 30, 2006.

(51) Int. Cl.
*A47L 9/10* (2006.01)

(52) U.S. Cl. ..... 15/353; 15/327.1

(58) Field of Classification Search ..... 15/353, 15/327.2, 327.3, 327.6
See application file for complete search history.

(56) References Cited

U.S. PATENT DOCUMENTS 4,797,072 A 1/1989 Berfield et al.
4,801,376 A * 1/1989 Kulitz ..... 210/123
4,906,265 A 3/1990 Berfield
5,404,614 A 4/1995 Stephens
5,455,983 A 10/1995 Crouser et al.
5,606,769 A 3/1997 Tomasiak et al.
5,954,863 A 9/1999 Loveless et al.
6,530,116 B2 * 3/2003 Berfield et al. ..... 15/328
7,291,195 B2 * 11/2007 Gierer ..... 55/467
7,374,595 B2 * 5/2008 Gierer ..... 55/498
2007/0261182 A1 * 11/2007 Fernandez-Grandizo Martinez et al. ..... 15/1

* cited by examiner

*Primary Examiner* — Dung Van Nguyen
(74) *Attorney, Agent, or Firm* — Locke Lord Bissell & Liddell LLP

(57) ABSTRACT

The present disclosure provides a filter cage having an improved flow path suitable even for restricted flow regions of a float container in the cage. The filter cage departs from generally accepted structural considerations and provides flow paths to one or more sides of the cage outside the restricted flow regions of the float container, but within the cross-sectional area of the cage structure. In one exemplary embodiment, the cage is oval-shaped with a cross-sectional area defined by a major and minor axis. A restricted flow region, such as the float container, encompasses a cross-sectional area corresponding in size to a cross-sectional area defined by the minor axis of the oval-shaped cage. The remaining portion of the cage cross-sectional areas provides one or more flow paths outward from the float container in the direction of the major axis of the cage.

14 Claims, 4 Drawing Sheets

OVAL FILTER CAGE AND VACUUM CLEANER

CROSS REFERENCE TO RELATED APPLICATIONS

The present application claims the benefit of U.S. Provisional Application No. 60/867,953 filed on Nov. 30, 2006, and is incorporated by reference herein.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates to the field of vacuum cleaners. More specifically, the disclosure relates to vacuum cleaners having removable filters.

2. Description of the Related Art

Wet and dry vacuum cleaners are equipped with special structures to allow selective suctioning of water or air. A suction system with a motor creates the vacuum and is mounted in a lid that is removably attached to a collection drum for receiving the vacuumed materials. A portion of the lid extends downward into the drum where a cylindrical filter support assembly, referenced herein as a "cage," is mounted thereto. A filter is mounted to the cage, where the cage and filter cover a vacuum intake to the suction assembly in the lid. The suction system suctions air from the drum which draws external air or water through a hose into the drum. Remaining material, mainly air, then flows radially inward through the filter to remove particles of debris, continues through the cage through a motorized suction impeller in the lid, and then is exhausted from the vacuum cleaner.

For manufacturing and structural integrity, a typical cage is formed from a set of horizontal concentric members as "bands" joined with upright longitudinal members. Air flow can pass through open spaces formed between the concentric bands and longitudinal members. The cage supports the filter on the cage outer periphery.

While suctioning water, the suction impeller and motor can be damaged if the water level in the drum rises to a height that the water directly contacts the impeller and creates additional stress on the spinning impeller and motor. As a safety feature to such occurrences, a float is commonly installed in the cage that will float at or above the liquid level. The float historically has been a ball float and more recently has been a cylindrical float. The float is held within the cage by the concentric bands and longitudinal members. In some designs, the float is held in alignment with the suction inlet by a guide around a portion of the float within the cage.

If the liquid level rises to a sufficient height, the float will rise and block the impeller intake to restrict the flow of liquid into the impeller. When the liquid level decreases, the float lowers and the air above the liquid level can flow into the impeller.

As motor efficiencies have increased, the amount of suction power has increased. On some high capacity wet and dry vacuums, the air flow is so great that the air flow can lift the float and unintentionally block the impeller inlet even without a high water level. Thus, the cage has been modified to create a restricted flow section of the cage.

FIG. 1 is a perspective schematic view of a typical prior art concentric filter cage having a restricted flow section installed in a wet and dry vacuum cleaner. The cage 2 has a series of concentric members 3 coupled with longitudinal members 4. A filter 5 is inserted over the cage 2. A restricted flow section 6 is created in a lower portion of the cage 2 where a float 7 would generally rest by forming a bottom-closed, open-top, float container 8 in the cage. Thus, airflow is blocked in the lower portions of the cage from the float, so that the float will only rise when water level rises and overflows into the open top of the float container 8. The air flow is primarily restricted to flow through the open flow zone 9 into the cage and then the impeller. Such restrictions can affect the performance in two ways. Only a portion of the filter is efficiently utilized. Further, the volume of air flow is restricted due to less than the full depth of the cage being available for air flow radially inward.

Therefore, there remains a need for an improved cage design and system for a filter in a vacuum cleaner.

BRIEF SUMMARY OF THE INVENTION

The present disclosure provides a filter cage having an improved flow path suitable even for restricted flow regions of a float container in the cage. The filter cage departs from generally accepted structural considerations and provides flow paths to one or more sides of the cage outside the restricted flow regions of the float container, but within the cross-sectional area of the cage structure. In one exemplary embodiment, the cage is oval-shaped with a cross-sectional area defined by a major and minor axis. A restricted flow region, such as the float container, encompasses a cross-sectional area corresponding in size to a cross-sectional area defined by the minor axis of the oval-shaped cage. The remaining portion of the cage cross-sectional areas provides one or more flow paths outward from the float container in the direction of the major axis of the cage. The filter is advantageously utilized along more of its longitudinal length even with the inclusion of the float container.

The disclosure provides a cage for a wet and dry vacuum cleaner, comprising: a plurality of rings surrounding a longitudinal axis, the rings having a first cross-sectional dimension and a second cross-sectional dimension measured at a right angle to the first cross-sectional dimension, the first and second cross-sectional dimensions defining an inside cross-sectional area; one or more longitudinal supports coupled to the plurality of rings to form a plurality of open spaces between the rings and supports; and a closed float container coupled to the rings, supports, or a combination thereof, the closed float container having an open top and defining an outside float container cross-sectional area, the outside float container cross-sectional area being smaller than the inside cross-sectional area to allow a first flow path between the inside surfaces of the rings and the outside surface of the closed float container.

The disclosure also provides a system for vacuuming materials, comprising: a wet and dry vacuum cleaner; and a cage to support a filter, the cage coupled to the vacuum cleaner and comprising: a plurality of oval-shaped rings surrounding a longitudinal axis, the rings having a first cross-sectional dimension shorter than a second cross-sectional dimension measured at a right angle to the first cross-sectional dimension, the first and second cross-sectional dimensions defining an inside cross-sectional area; one or more longitudinal supports coupled to the plurality of rings to form a plurality of open spaces between the rings and supports; and a circular closed float container coupled to the rings, supports, or a combination thereof, the closed float container having an open top and defining an outside float container cross-sectional area, wherein the coupling of the float container defines a first partial flow path between the float container and the rings on a first side of the cage and a second partial flow path between the float container and the rings on a second side of the cage distal from the first side.

BRIEF DESCRIPTION OF THE SEVERAL VIEWS OF THE DRAWINGS

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art as required by 35 U.S.C. §112.

DETAILED DESCRIPTION

One or more illustrative embodiments incorporating the invention disclosed herein are presented below. Not all features of an actual implementation are described or shown in this application for the sake of clarity. It is understood that the development of an actual embodiment incorporating the present invention, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill in the art having benefit of this disclosure.

Figure 2:
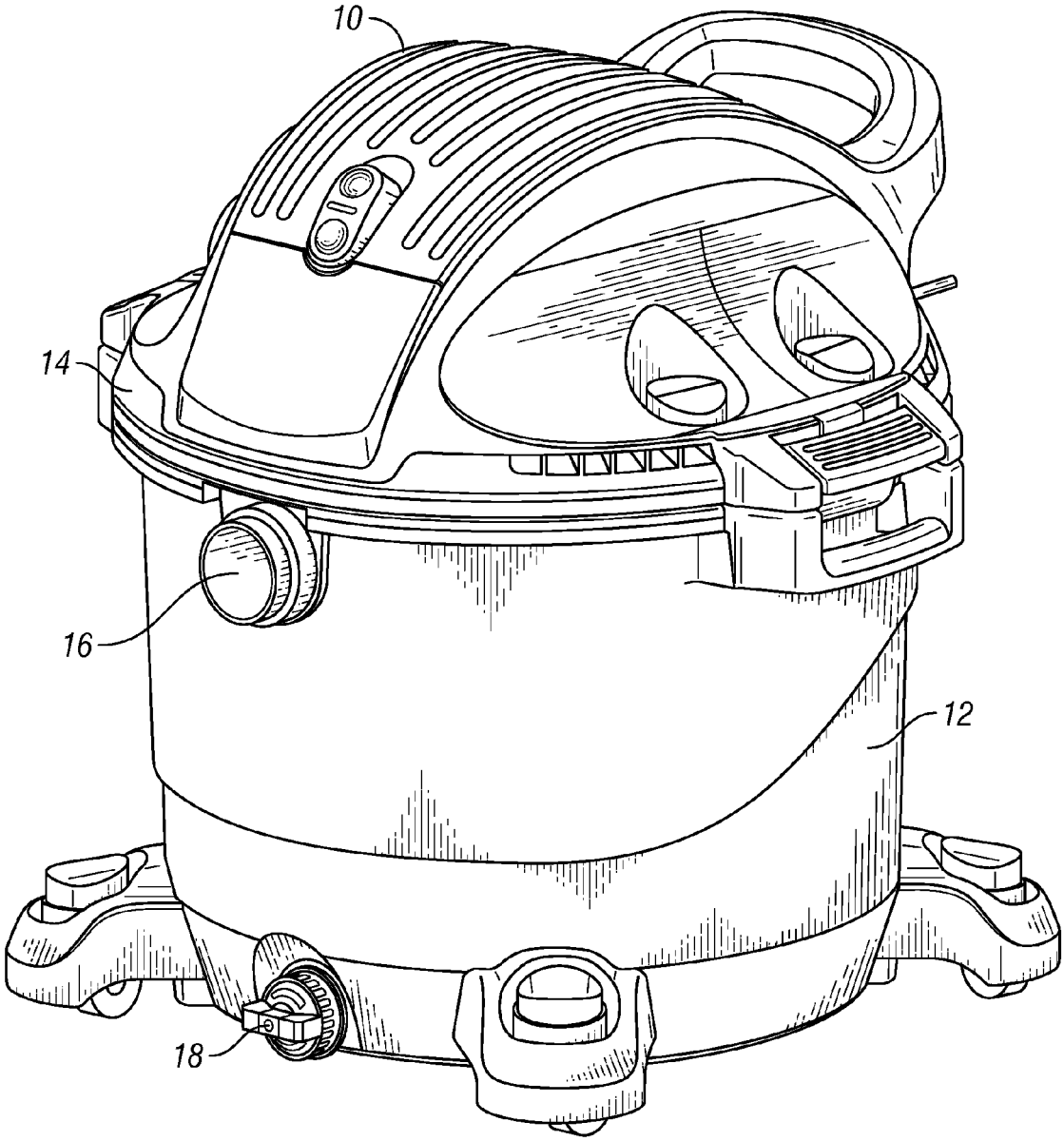
FIG. 2 is a wet and dry vacuum cleaner having an oval filter cage installed therein according to the disclosure.

FIG. 2 is a schematic perspective view of an exemplary embodiment of a vacuum cleaner 10, such as a wet and dry vacuum cleaner. The vacuum cleaner 10 includes a collection drum 12 and a lid 14 removably attached to the collection drum, so that the drum can be emptied of debris or liquids contained therein. As with known wet and dry vacuums, a motor and an impeller are generally coupled to the mounting assembly (not shown) on the inside portion of the lid 14 of the vacuum cleaner. The activation of the motor with the impeller creates the vacuum inside the collection drum 12 to draw the debris or liquid into the drum through an inlet port 16. The filter cage described herein is mounted to the mounting assembly inside the vacuum cleaner to filter dust and particles from the incoming material before entering the impeller region. The collection drum can further include a drain 18, so that liquid can be emptied from the collection drum 12 without removing the lid 14.

Figure 3:
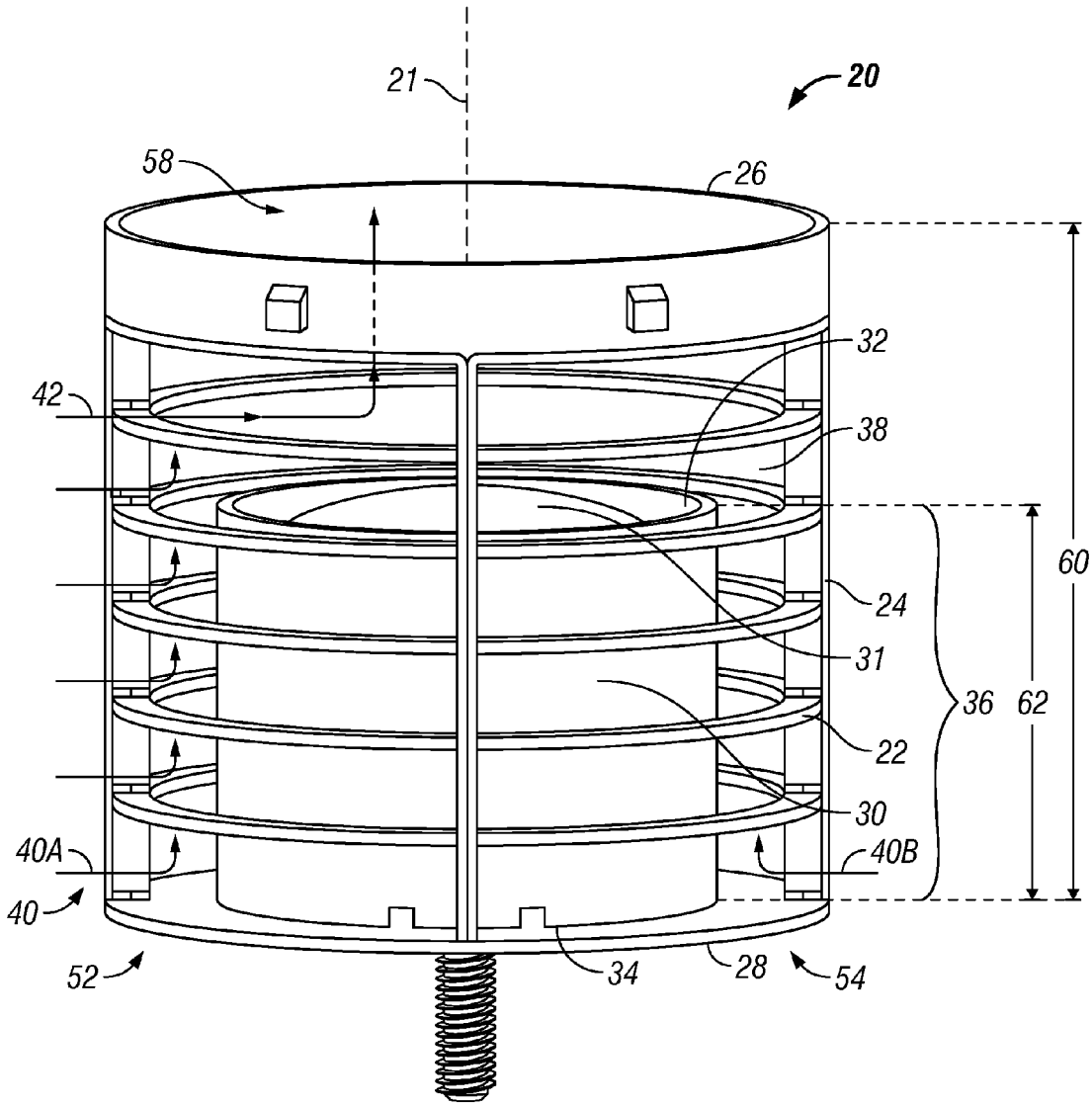
FIG. 3 is a perspective schematic view of the filter cage.

FIG. 3 is a perspective schematic view of the filter cage. An exemplary filter cage 20 as disclosed herein generally includes a longitudinal axis 21 about which various structural members are aligned. A series of lateral rings 22 can be aligned transverse to the longitudinal axis and be coupled with one or more longitudinal members 24. The longitudinal members can be formed integrally with the lateral rings or formed separately and assembled thereto. The term "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The rings are shown as continuous, but it is understood that the rings can also be segmented, spaced, or other designs to provide the necessary structural support for the cage as would be known to those with ordinary skill in the art. Similarly, the longitudinal members 24 can be formed at right angles to the rings and aligned with the longitudinal axis 21. Alternatively, the longitudinal members can be formed at non-right angles, so that the angles could be greater than zero and less than 90° relative to the longitudinal axis 21, as may be suitable to be coupled to the rings.

Figure 1:
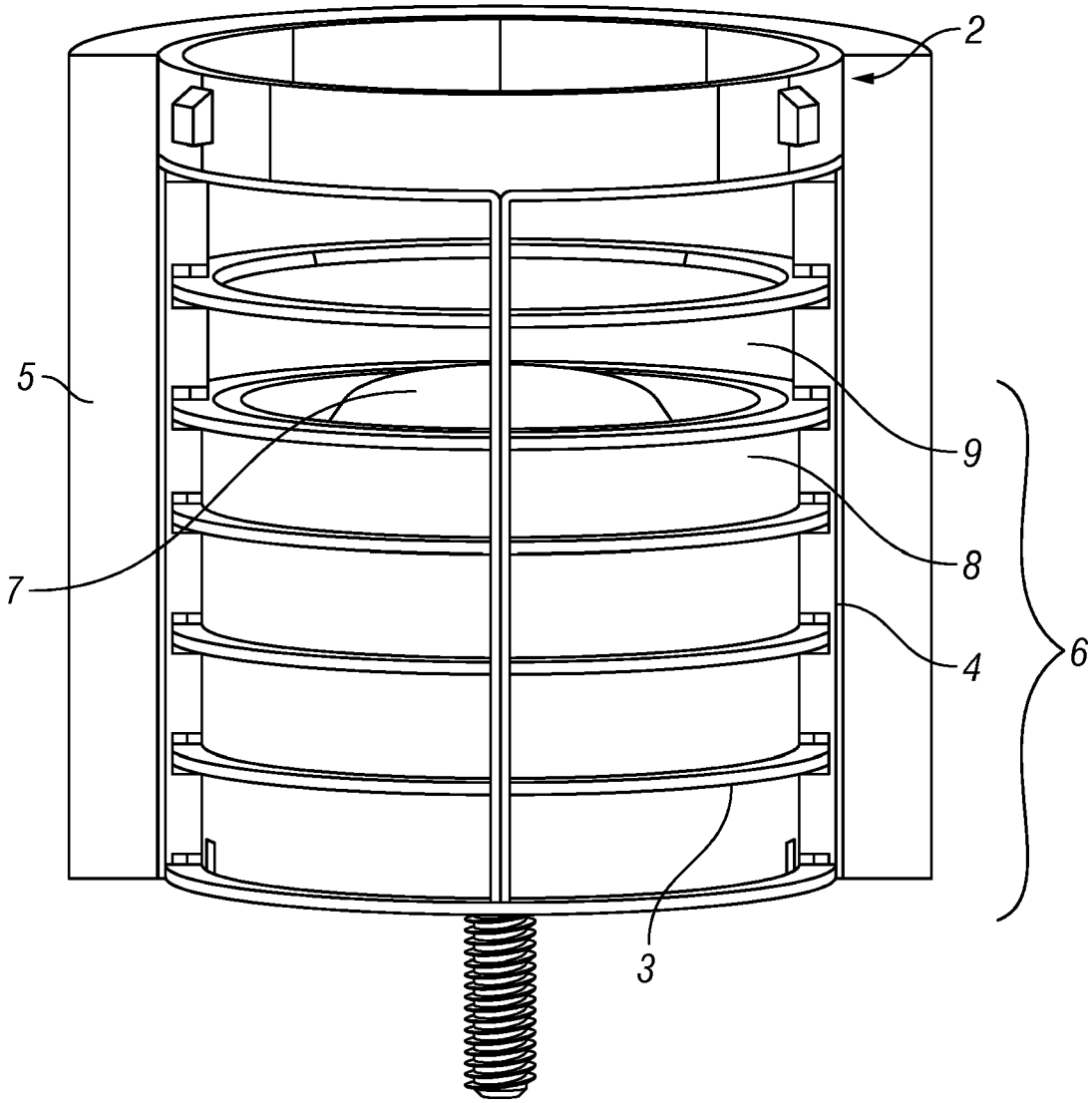
FIG. 1 (Prior Art)
FIG. 1 is a perspective schematic view of a typical prior art concentric filter cage having a restricted flow section installed in a wet and dry vacuum cleaner.

The filter cage 20 generally has an open top 26 which is mounted to the inside structure of the lid 14 such as the mounting assembly (not shown), as is understood by those in the art. The filter cage bottom 28 generally is closed, so that flow is restricted through the bottom to force any flow through a filter surrounding the cage, such as the filter 5 described in FIG. 1. The term "closed" is used broadly herein and generally includes a restricted flow path but could in some instances include minor openings that would not significantly interfere with the functioning and purpose of directing the flow through the filter. The cage 20 further can include a float container 30 generally coupled to the bottom of the cage. The float container bottom 34 can be integral with the cage bottom 28 and or separately and attached thereto. The float container 30 is similarly closed to restrict air flow passing through the bottom and side of the float container, but open at a top 32 of the float container, so that a float 31 can rise when a liquid level increases in the drum 12 shown in FIG. 2. The float container can similarly include minor openings that would not significantly interfere with the functioning and purpose of protecting the float from high air flow rates and causing a premature lifting of the float to the impeller opening, as described in the background section herein. The cage 20 defines a longitudinal length 60 in the direction of the longitudinal axis 21. The float container defines a second length 62 that is generally shorter than the length of the cage.

Uniquely, the cage of the present disclosure provides a first zone of open spaces 36 that allows air flow therethrough even in the presence of the restricted flow region of the float container 30. The first zone of open spaces 36 is formed between the lateral rings 22 and the longitudinal members 24 that is generally along the length 62 of the float container 30. A second zone of open spaces 38 is formed above the length 62 of the float container. As described herein, flow paths can be formed in both zones in contrast to the prior art shown and described in reference to FIG. 1. For example, a first flow path 40 can be formed through the zone of open spaces 36, then between the rings and longitudinal members on one hand and the outside surface of the float container 30 on the other hand. In at least one embodiment, a first partial air flow part 40A can be formed between the rings/longitudinal members and the float container on a first side 52 of the cage 20, and a second partial flow path 40B can be formed on a second side 54 of the cage, where the second side is distal from the first side relative to the float container 30. Depending on the particular shape of the float of the cage 20 and the float container 30, the particular location of the flow paths can vary.

Above the length 62 of the float container, a second flow path 42 is formed that can flow through the zone of open spaces 38 and into a flow zone 58. The flow zone 58 includes substantially the inside cross-sectional area of the filter cage 20 without the float container. Thus, the second flow path 42 can flow into the cross-sectional area of the cage without reduction of the cross-sectional area of the float container, and is therefore greater in cross-sectional area than the first flow path.

Figure 4:
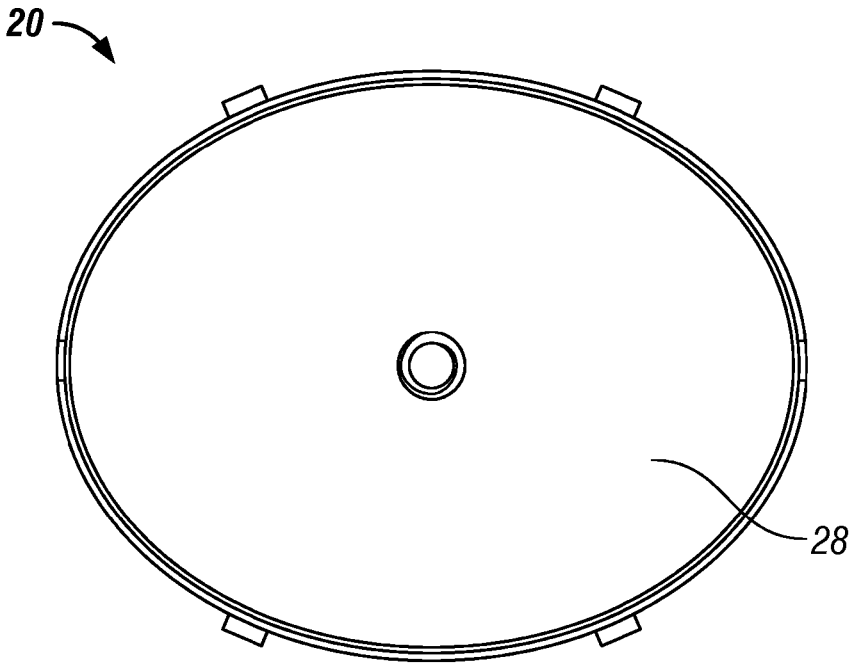
FIG. 4 is a bottom schematic view of the filter cage.
Figure 5:
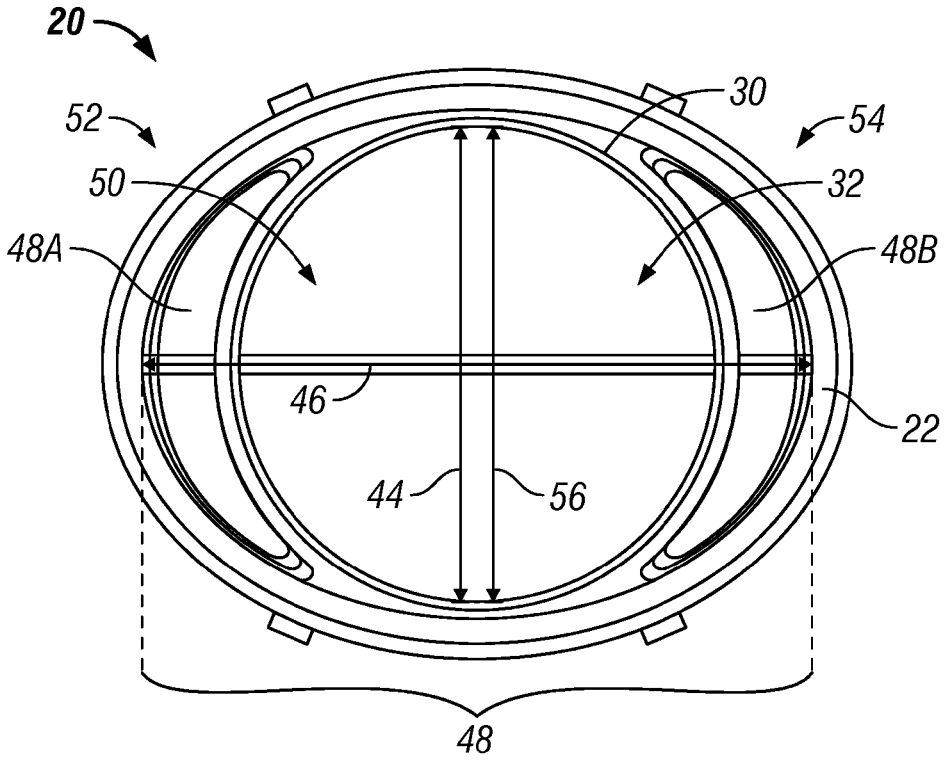
FIG. 5 is a top schematic view of the filter cage.

FIG. 4 is a bottom schematic view of the filter cage. FIG. 5 is a top schematic view of the filter cage. The figures will be described in conjunction with each other. In at least one exemplary embodiment, the filter cage 20 can be oval-shaped. Other shapes are contemplated, available, and within the scope of the claims recited herein. For example and without limitation, the shape could be other geometric shapes, such as hexagonal, octagonal, square rectangular and other shapes as would allow a float to cover an inlet to an impeller, be protected from high air flow rates by a float container, and yet have the air flow path along the outer surfaces of the float container and within the cage inner cross-sectional area. For the exemplary and non-limiting embodiment shown, the cage 20 can include a minor axis 44 and a major axis 46 or more broadly, a first cross-sectional dimension and a second cross-sectional dimension, measured at a right angle to the first cross-sectional dimension. The minor and major axis (first and second cross-sectional dimensions) define an inside cross-sectional area. Similarly, the external periphery of the float container 30, having a dimension 56, can define an outer float container cross-sectional area 50. As shown in FIG. 5, if the float container is circular, then the float container can be sized to approximate the minor axis 44, so that the cross-sectional area of the float container has the same or similar area as a cross-sectional area defined by the minor axis 44 of the cage. Remaining cross-sectional areas 48A, 48B to either side 52, 54 of the cage. In such instances, the flow path through the cross-sectional areas 48A, 48B could be described as symmetrical. Other shapes and dispositions of one or more flow areas could be made. For example, the float container 30 could be shaped in a nonsymmetrical manner, so that it could be disposed toward one side of the cage 20 leaving a greater flow area in other portions of the cross-sectional area of the cage. Thus, the embodiment shown is exemplary.

The various steps described or claimed herein can be combined with other steps, can occur in a variety of sequences unless otherwise specifically limited, various steps can be interlineated with the stated steps, and the stated steps can be split into multiple steps. Unless the context requires otherwise, the word "comprise" or variations such as "comprises" or "comprising", should be understood to imply the inclusion of at least the stated element or step or group of elements or steps or equivalents thereof, and not the exclusion of any other element or step or group of elements or steps or equivalents thereof. Also, any directions such as "top," "bottom," "left," "right," "upper," "lower," and other directions and orientations are described herein for clarity in reference to the figures and are not to be limiting of the actual device or system or use of the device or system. The device or system may be used in a number of directions and orientations.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant(s), but rather, in conformity with the patent laws, Applicant(s) intend to protect all such modifications and improvements to the full extent that such falls within the scope or range of equivalent of the following claims.

Further, any documents to which reference is made in the application for this patent as well as all references listed in any list of references filed with the application are hereby incorporated by reference. However, to the extent statements might be considered inconsistent with the patenting of this invention such statements are expressly not to be considered as made by the Applicant(s).

The invention claimed is:

1. A filter cage for use with a wet and dry vacuum cleaner, the filter cage comprising:

an open top and a spaced-apart, substantially parallel cage bottom;

a plurality of lateral rings surrounding a longitudinal axis of the cage, the rings having a first cross-sectional dimension and a second cross-sectional dimension, the second cross-sectional dimension being measured at a right angle to the first cross-sectional dimension, wherein the first and second cross-sectional dimensions define an inside cross-sectional area of the filter cage;

one or more longitudinal supports coupled to the plurality of rings to form a plurality of open spaces between the rings and supports; and a closed float container coupled to the rings, supports, bottom of the cage, or a combination thereof, the closed float container having an open top, a longitudinal length substantially parallel to the longitudinal axis of the filter cage, and an external periphery, the external periphery of the float container defining an outside float container cross-sectional area, the outside float container cross-sectional area being smaller than the inside cross-sectional area of the filter cage to allow a first flow path between the cross-sectional area formed between the inside surfaces of the lateral rings and the outside surface of the closed float container, wherein a second flow path is formed above the length of the float container that can flow through the zone of open spaces formed above the length of the float container and into a flow zone that includes substantially the inside cross-sectional area of the filter cage without the float container, and wherein the rings are oval-shaped, such that the cage is oval-shaped.

2. The cage of claim 1, wherein the first cross-sectional dimension has a different dimension in length than the second cross-sectional dimension.

3. The cage of claim 2, wherein the first flow path comprises a first partial flow path between the float container and the rings on a first side of the cage and a second partial flow path between the float container and the rings on a second side of the cage distal from the first side.

4. The cage of claim 2, wherein the first flow path is symmetrically disposed between the float container and a first side of the rings and the float container and a second side of the rings distal from the first side.

5. The cage of claim 1, wherein the external periphery of the float container is circular, and wherein the first cross-sectional dimension of the rings of the cage is shorter than the second cross-sectional dimension.

6. The cage of claim 5, wherein the first cross-sectional dimension is shorter than the second cross-sectional dimension and wherein the external periphery of the float container is adjacent the rings at the first cross-sectional dimension.

7. The cage of claim 1, further comprising an additional flow path through one or more open spaces between the rings and the longitudinal supports of the filter cage, the additional flow path being open to an air flow zone of the cage having a greater cross-sectional area than the first flow path.

8. The cage of claim 1, wherein the cage comprises an open top and a closed bottom, the cage defining an overall first length, and the float container defining a second length shorter than the first length, the float container being coupled to the bottom of the cage.

9. A system for vacuuming materials, comprising:

a vacuum cleaner; and the cage of claim 1.

10. A system for vacuuming materials, the system comprising:

a wet and dry vacuum cleaner; and a filter cage to support a filter, the filter cage coupled to the vacuum cleaner and comprising:

a plurality of oval-shaped rings surrounding a longitudinal axis of the cage, the rings having a first cross-sectional dimension and a second cross-sectional dimension measured at a right angle to the first cross-sectional dimension, the first cross-sectional dimension being shorter than the second cross-sectional dimension, wherein the first and second cross-sectional dimensions defining an inside cross-sectional area of the filter cage;

one or more longitudinal supports coupled to the plurality of rings to form a plurality of open spaces between the rings and supports; and a circular closed float container coupled to the rings, supports, or a combination thereof, the closed float container having an open top, a longitudinal length substantially parallel to the longitudinal axis of the filter cage, and an external periphery, the external periphery of the float container defining an outside float container cross-sectional area, wherein the coupling of the float container to the rings, supports, or a combination thereof defines a first partial flow path between the float container and the rings on a first side of the cage and a second partial flow path between the float container and the rings on a second side of the cage distal from the first side.

11. The cage of claim 10, wherein the first flow path is symmetrically disposed between the float container and a first side of the rings and the float container and a second side of the rings distal from the first side.

12. The cage of claim 10, further comprising a second flow path through one or more open spaces between the rings and the longitudinal supports, the second flow path being open to an air flow zone of the cage having a smaller cross-sectional area than the closed float container.

13. The cage of claim 10, wherein the cage comprises an open top and a closed bottom, the cage defining an overall first length, and the float container defining a second length shorter than the first length, the float container being further coupled to the bottom of the cage.

14. The cage of claim 10, further comprising a flow path formed above the length of the float container that flows through the zone of open spaces formed above the length of the float container and into a flow zone that includes substantially the inside cross-sectional area of the filter cage without the float container.

* * * * *